US005395224A

United States Patent [19]

Caillat et al.

[11] Patent Number: 5,395,224

[45] Date of Patent: Mar. 7, 1995

[54] SCROLL MACHINE LUBRICATION SYSTEM INCLUDING THE ORBITING SCROLL MEMBER

[75] Inventors: Jean-Luc Caillat, Dayton; Stephen M. Seibel, Sidney, both of Ohio

[73] Assignee: Copeland Corporation, Sidney, Ohio

[21] Appl. No.: 108,466

[22] Filed: Aug. 18, 1993

Related U.S. Application Data

[63] Continuation of Ser. No. 861,338, Mar. 30, 1992, abandoned, which is a continuation of Ser. No. 560,140, Jul. 31, 1990, abandoned.

[51] Int. Cl.[6] ..... F01C 1/04; F01C 21/04

[52] U.S. Cl. ..... 418/55.6; 418/88; 418/94; 418/99; 418/100

[58] Field of Search ..... 418/55.6, 88, 91, 94, 418/99, 100

[56] References Cited

U.S. PATENT DOCUMENTS

| | | | |
|---|---|---|---|
| Re. 33,236 | 6/1990 | Hazaki et al. | 418/55.6 |
| 4,637,786 | 1/1987 | Matoba et al. | 418/55.6 |
| 4,874,302 | 10/1989 | Kobayashi et al. | 418/55.6 |

FOREIGN PATENT DOCUMENTS

| | | | |
|---|---|---|---|
| 58-214691 | 12/1983 | Japan | 418/55.6 |
| 59-113290 | 6/1984 | Japan | 418/94 |
| 59-180093 | 10/1984 | Japan . | |
| 60-204990 | 10/1985 | Japan | 418/94 |
| 61-192881 | 8/1986 | Japan | 418/55.6 |
| 63-131889 | 6/1988 | Japan | 418/88 |
| 1290984 | 11/1989 | Japan | 418/55.6 |
| 1300080 | 12/1989 | Japan | 418/55.6 |
| 2-49989 | 2/1990 | Japan | 418/100 |

*Primary Examiner*—John J. Vrablik

*Attorney, Agent, or Firm*—Harness, Dickey & Pierce

[57] ABSTRACT

A lubrication system for a scroll machine which, to any extent desired, can utilize the centrifugal forces generated by the orbiting of the orbiting scroll member to influence, either positively or negatively, the flow of fluid in a portion of the lubricant system. This fluid can be either a lubricating oil fed to the thrust bearing for normal lubrication, an oil injection into the intermeshed scrolls to increase sealing and efficiency while attenuating noise, or a venting of vapor from some point in the lubrication system.

39 Claims, 8 Drawing Sheets

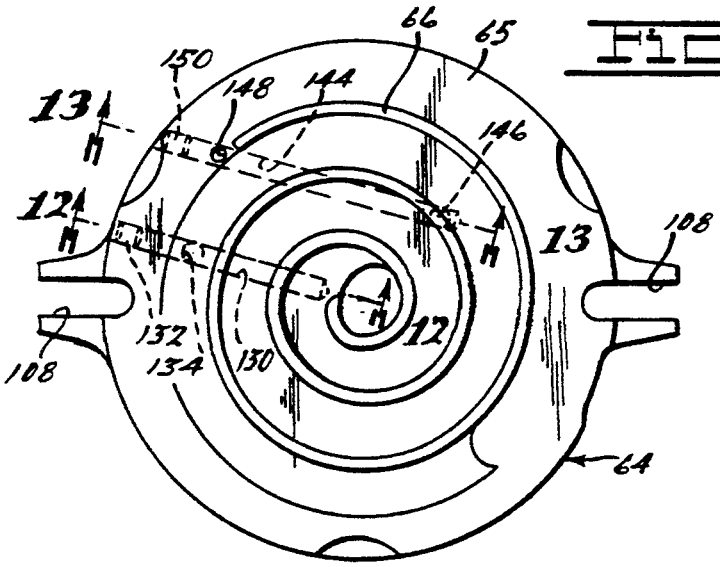
FIG. 11.
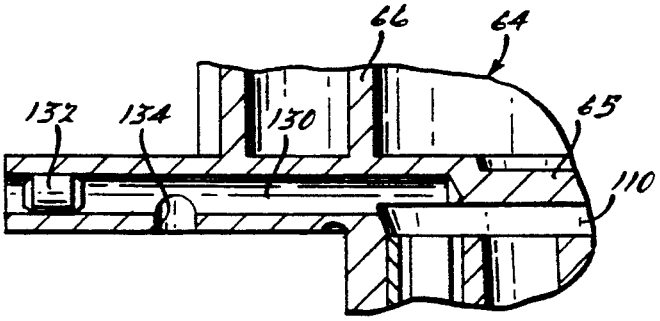
FIG. 12.
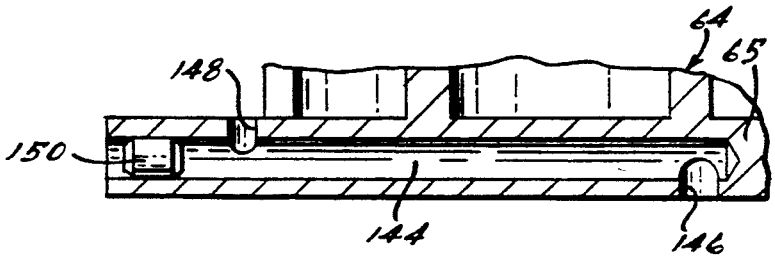
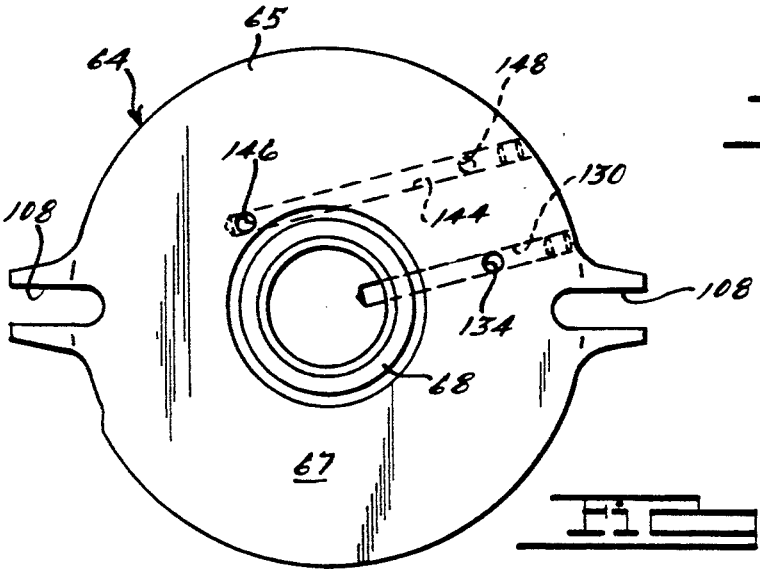
FIG. 13.
FIG. 14.

SCROLL MACHINE LUBRICATION SYSTEM INCLUDING THE ORBITING SCROLL MEMBER

This is a continuation of U.S. patent application Ser. No. 07/861,338, filed Mar. 30, 1992, now abandoned, which is a continuation of U.S. Ser. No. 560,140, filed Jul. 31, 1990, now abandoned.

The present invention relates to scroll-type machinery, and more particularly to an improved lubricating system for scroll compressors.

BACKGROUND AND SUMMARY OF THE INVENTION

A typical scroll machine has an orbiting scroll member which meshes with a non-orbiting scroll member, a thrust bearing to take the axial loads on the orbiting scroll member, and a lubricant supply system for lubricating the various moving parts of the machine, including the thrust bearing. Accordingly, there is a continuing need in the field of scroll machines for improved lubricating techniques.

It is therefore a primary object of this invention to provide an improved lubrication system which, to any extent desired, can utilize the centrifugal forces generated by the orbiting of the orbiting scroll member to influence, either positively or negatively, the flow of fluid in a portion of the lubricant system. This fluid can be either a lubricating oil fed to the thrust bearing for normal lubrication, an oil injection into the intermeshed scrolls to increase sealing and efficiency while attenuating noise, or a venting of vapor from some point in the lubrication system. A related object concerns the provision of such a system which is extensively simple and inexpensive to implement, which requires no additional parts and which is really suited for incorporation in a variable speed refrigerant compressor.

These and other objects and advantages will become more apparent when viewed in light of the accompanying drawings and following detailed description.

BRIEF DESCRIPTION OF THE DRAWING FIGURES

FIG. 11 is a top plan view of an orbiting scroll member of another embodiment of the present invention;

FIG. 12 is a vertical sectional view taken substantially along line 12—12 in FIG. 11;

FIG. 13 is a vertical sectional view taken substantially along line 13—13 in FIG. 11;

FIG. 14 is a bottom plan view of the orbiting scroll member of FIG. 11;

DETAILED DESCRIPTION OF THE PREFERRED EMBODIMENTS

Figure 1:
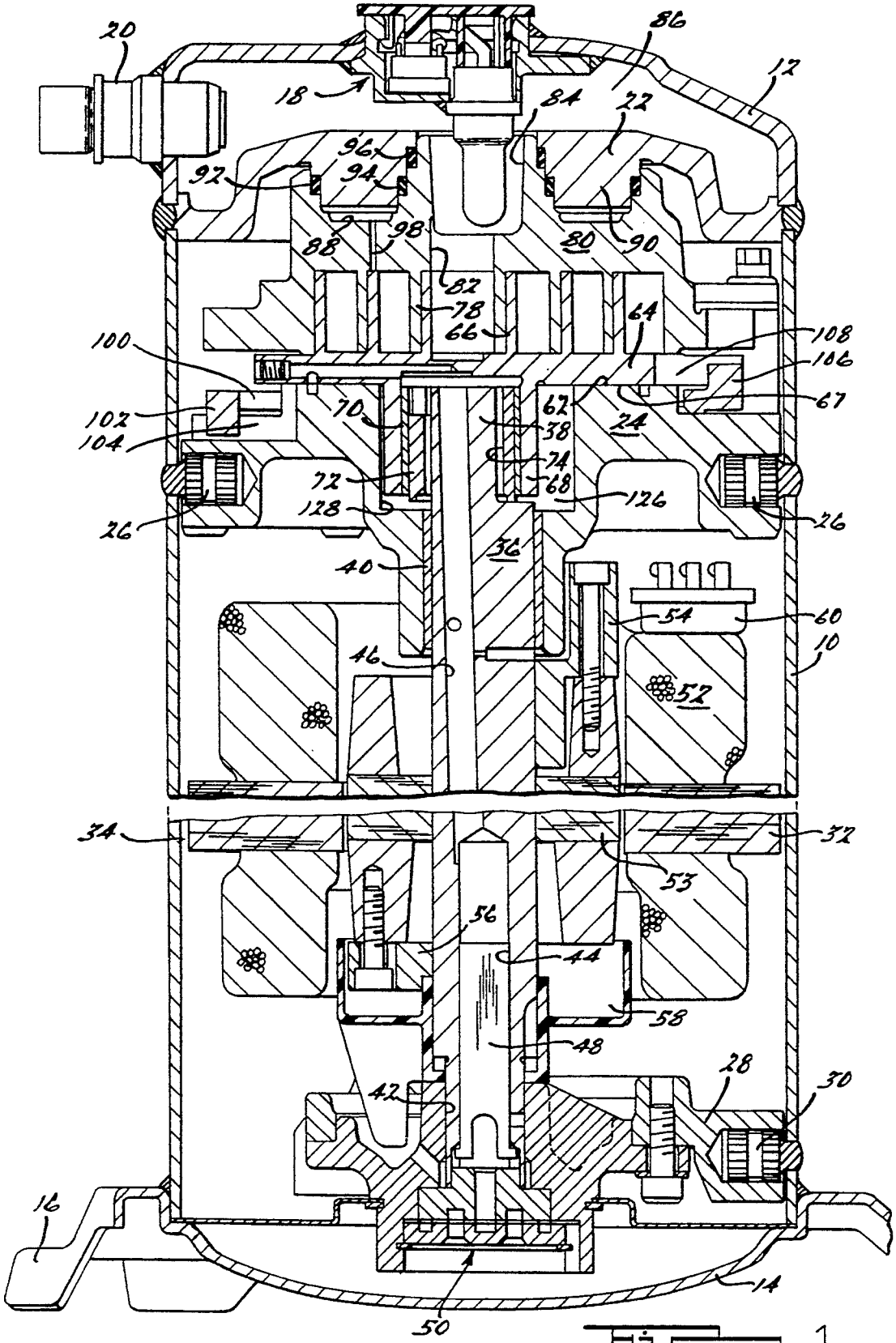
FIG. 1 is a vertical sectional view through a hermetic scroll compressor embodying the principles of the present invention.

While the present invention is suitable for incorporation in many different types of scroll machines, for exemplary purposes it will be described herein incorporated in a scroll compressor of the general structure illustrated in vertical section in FIG. 1. Generally speaking, the compressor comprises a generally cylindrical hermetic shell 10 having welded at the upper end thereof a cap 12 and at the lower end thereof a base 14 having a plurality of feet 16. Cap 12 is provided with a thermostat assembly indicated generally at 18 which has a portion extending into the interior of the shell, and a refrigerant discharge fitting 20 which may have the usual discharge valve therein (not shown). Other major elements affixed to the shell include a transversely extending partition 22 which is welded about its periphery at the same point that cap 12 is welded to shell 10, a main bearing housing 24 which is pin welded to shell 10 at a plurality of points utilizing pins 26, and a lower bearing housing 28 having a plurality of radially outwardly extending legs each of which is pin welded to shell 10 utilizing a pin 30. A motor stator 32 which is generally square in cross-section but with the corners rounded off is press fit into shell 10. The flats between the rounded corners on the stator provide passageways between the stator and shell, indicated at 34 which facilitate the flow of lubricant from the top of the shell to the bottom. A crankshaft 36 having an eccentric crank pin 38 at the upper end thereof is rotatably journaled in a bearing 40 in main bearing housing 24 and a second bearing 42 in lower bearing housing 28. Crankshaft 36 has at the lower end a relatively large diameter concentric bore 44 which communicates with a radially outwardly inclined smaller diameter bore 46 extending upwardly therefrom to the top of the crankshaft. Disposed within bore 44 is a stirrer 48 and keyed to the bottom of the crankshaft is a lubricating oil pump indicated generally at 50. The lower portion of the interior shell 10 is filled with lubricating oil and pump 50 is the primary pump acting in conjunction with bore 44 which acts as a secondary pump to pump lubricating fluid up the crankshaft and into passageway 46 and ultimately to all of the various portions of the compressor which require lubrication.

Crankshaft 36 is rotatively driven by an electric motor including stator 32, windings 52 passing therethrough and a rotor 53 press fit on the crankshaft and having upper and lower counterweights 54 and 56 respectively. A counterweight shield 58 may be provided to reduce the work loss caused by counterweight 56 spinning in the oil in the sump. For example, see the disclosure in assignee's U.S. Pat. No. 4,895,496, the disclosure of which is herein incorporated by reference. The usual motor protector 60 may be affixed to the windings in order to provide conventional overheating protection.

The upper surface of main bearing housing 24 is provided with an annular flat thrust bearing surface 62 on which is disposed an orbiting scroll member 64 comprising an end plate 65 having the usual spiral vane or wrap 66 on the upper surface thereof, an annular flat thrust surface 67 on the lower surface, and projecting downwardly therefrom a cylindrical hub 68 having a journal bearing 70 therein and in which is rotatively disposed a drive bushing 72 having an inner bore 74 in which crank pin 38 is drivingly disposed. Crank pin 38 has a flat on one surface (not shown) which drivingly engages a flat surface in a portion of bore 74 (not shown) to provide a radially compliant driving arrangement, such as shown in assignee's U.S. Pat. No. 4,877,382, the disclosure of which is herein incorporated by reference.

Wrap 66 meshes with a non-orbiting spiral wrap 78 forming a part of non-orbiting scroll member 80 which is mounted to main bearing housing 24 in any desired manner which will provide limited axial movement of scroll member 80 (the manner of such mounting not being relevant to the present invention). Non-orbiting scroll member 80 has a centrally disposed discharge passageway 82 communicating with an upwardly open recess 84 which is in fluid communication with the discharge muffler chamber 86 defined by cap 12 and partition 22. Non-orbiting scroll member 80 has in the upper surface thereof an annular recess 88 in which is sealingly disposed for relative axial movement an annular piston 90 integrally formed on partition 22. Annular elastomeric seals 92, 94 and 96 serve to isolate the bottom of recess 88 from the presence of gas under discharge pressure so that it could be placed in fluid communication with a source of intermediate fluid pressure by means of a passageway 98. The non-orbiting scroll member is thus axially biased against the orbiting scroll member by the forces created by discharge pressure acting on the central portion of scroll member 80 and those created by intermediate fluid pressure acting on the bottom of recess 88. This axial pressure biasing, and the technique for supporting scroll member 80 for limited axial movement, are disclosed in much greater detail in assignee's aforesaid U.S. Pat. No. 4,877,328.

Relative rotation of the scroll members is prevented by the usual Oldham coupling comprising a ring 100 having a first pair of keys 102 (one of which is shown) slidably disposed in diametrically opposed slots 104 in body member 24 and a second pair of keys 106 (one of which is shown) slidably disposed in diametrically opposed slots 108 in scroll member 64.

The scroll compressor as thus far broadly described is either now known in the art or is the subject matter of other pending applications for patent by applicants' assignee. The details of construction which incorporate the principles of the present invention are those which deal with lubrication of the thrust bearings between surfaces 62 and 67, venting of the lubrication system to improve reliability, and the injection of a small amount of lubricating oil into the gaseous refrigerant just prior to compression to increase efficiency and reduce noise.

Figure 2:
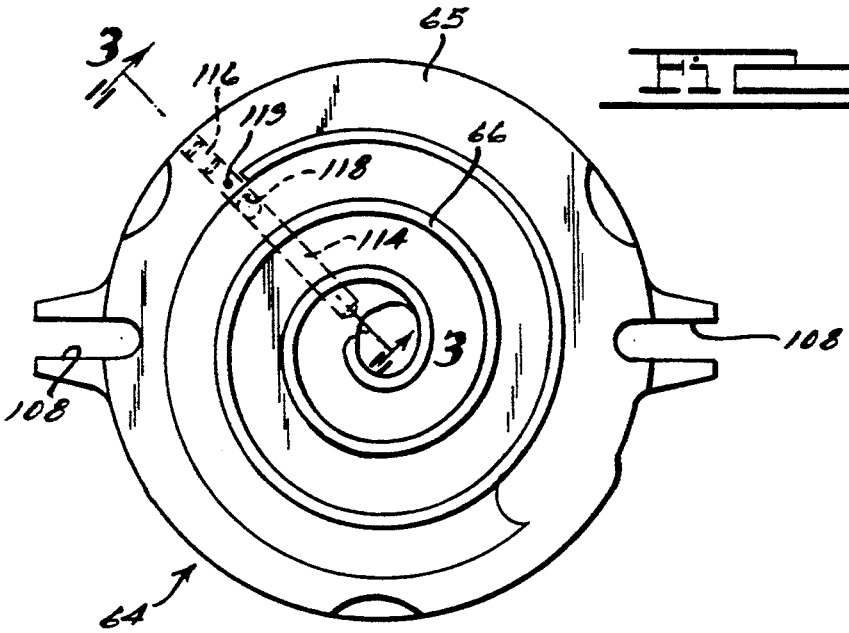
FIG. 2 is a top plan view of the orbiting scroll member of the compressor of FIG. 1.
Figure 3:
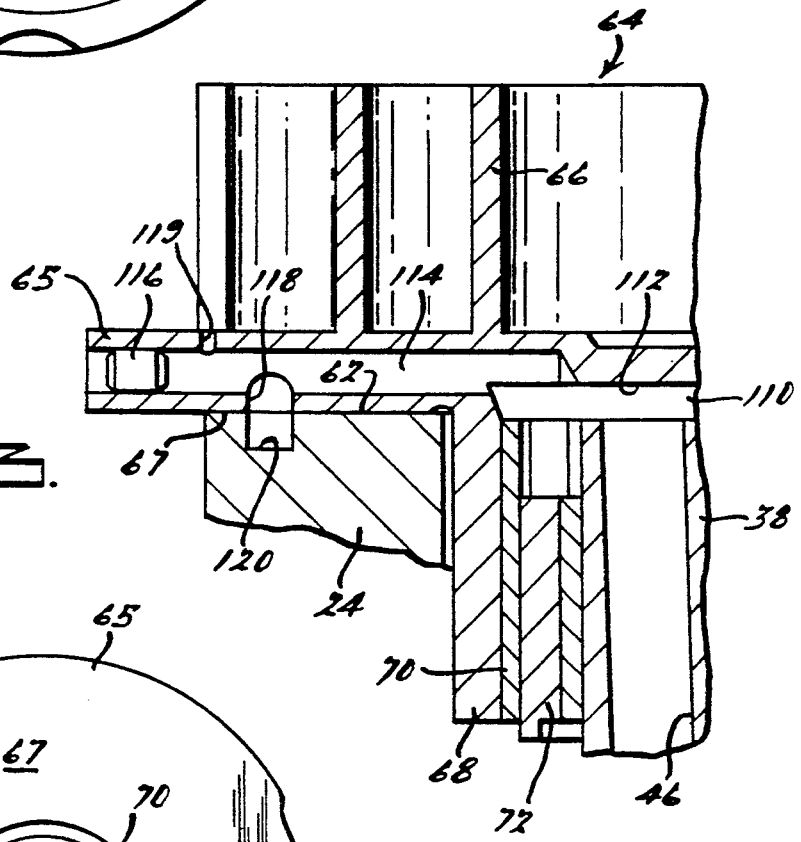
FIG. 3 is a vertical sectional view taken generally along line 3—3 in FIG. 2.
Figure 4:
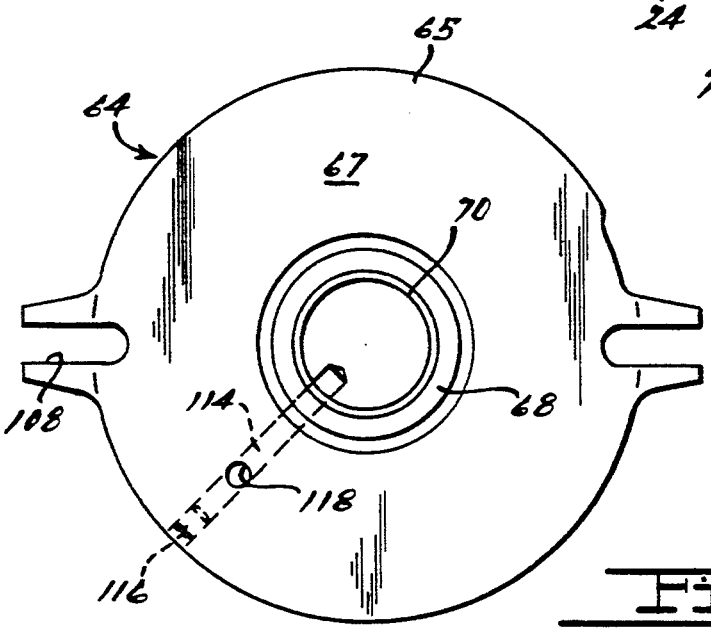
FIG. 4 is a bottom plan view of the orbiting scroll member of FIG. 2.

Thrust bearing lubrication and oil injection in their simplest form herein are illustrated in FIGS. 2–4. Oil is supplied to a chamber 110 disposed in the central portion of orbiting scroll member 64 and defined by the top of crank pin 38 and bushing 72 on the one side and by the blind end 112 of hub 68 on the other side (FIG. 3). Chamber 110 communicates directly and continuously with a radially outwardly extending passage 114 in end plate 65 which is closed at its outer end by a press fit plug 116 and communicates intermediate its ends with a lubrication port 118 which is downwardly open to thrust surface 67, and an oil injection port 119 open upwardly to the surface of the scroll end plate adjacent the end of the spiral wrap where suction gas is inducted into the machine. In the position shown in FIG. 3, where orbiting scroll member 64 is at its maximum orbiting radius position in the direction of the ports, port 118 is in full fluid communication with an annular oil supply groove 120 which is concentric with the axis of crankshaft 36 and which acts as the primary oil supply for the thrust bearing. As scroll member 64 continues to orbit, part 118 progressively moves out of communication with groove 120, as can be easily visualized. As a consequence, oil is supplied to the groove only when the inertia forces on the oil in passage 114 due to orbiting of orbiting scroll member 64 are in a direction to enhance oil flow through port 118 into groove 120.

Oil for injection flows through port 119 whereupon it is carried into the compressor by the gaseous refrigerant as it is drawn in to the compressor. Because port 119 is always in communication with chamber 110, oil will flow therethrough on a cyclic basis whenever inertial forces permit such flow. If desired, passage 114 can be provided with only a single oil outlet port, and that can be either port 118 or port 119.

Figure 5:
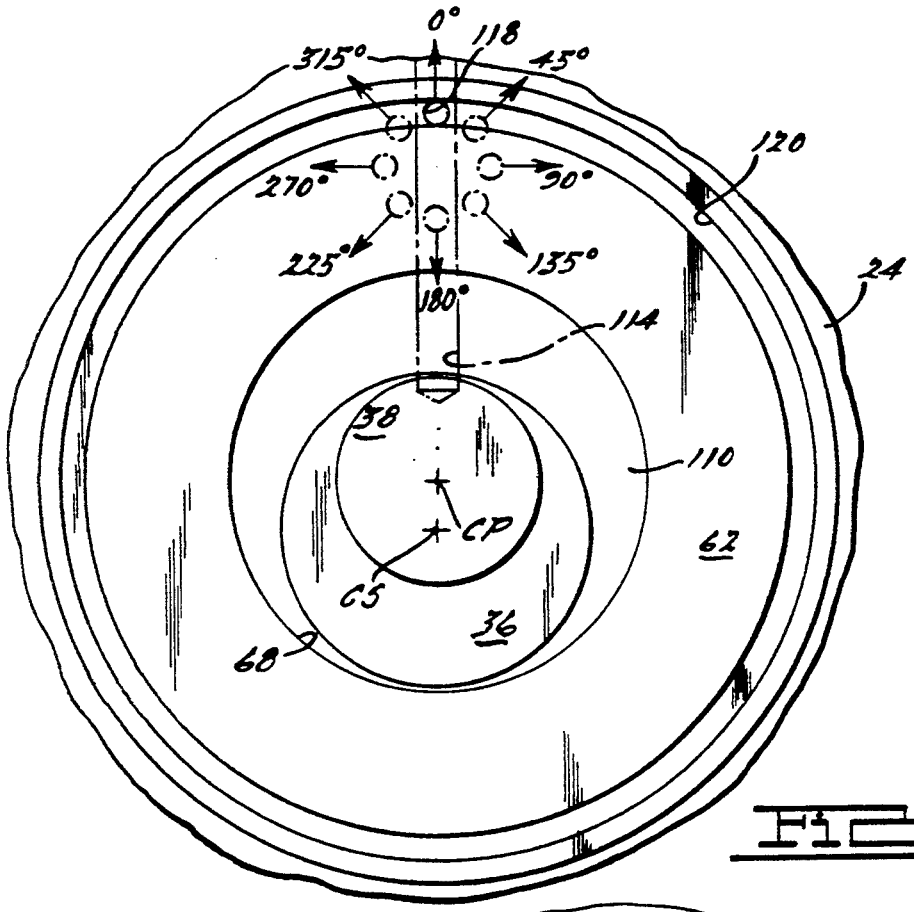
FIGS. 5, 6A and 6B are diagrammatic views illustrating certain port configurations of the embodiment of FIGS. 1–4 as a function of crank angle.

The location on the orbiting scroll member of the oil inlet and outlet ports, whether for injection or lubrication, relative to the position of the crank pin in each cycle of operation is what determines the inertial effect on the oil flow caused by the centrifugal forces created by the orbital movement of the orbiting scroll member. For example, with reference to FIG. 5, if the outlet port is located so that it is fully open when in a position in line with (or in the same plane) the center axes of the crankshaft and crank pin, indicated at cs and cp respectively, and in the direction of the crank pin, then it is at a position of maximum centrifugal force, and the inertial forces on the oil tending to cause it to flow out the port are maximum. This point is the 0° position of the crank pin in FIG. 5. Thus, in FIG. 5 the location of port 118 (solid line circle) is at the 0° position of the crank pin (0° crank angle) as shown, and passage 114 is in the position shown. In interpreting this figure (and the other diagrammatic views in this disclosure) it should be appreciated that the ports and passages are really above the plane of the drawing (in the orbiting scroll member) and therefore it is only their relative positions which are represented. The other positions of port 118 relative to groove 120 as the orbiting scroll member orbits are shown in phantom lines, labeled by the crank angle at that point in the orbit.

Although lubrication at a 0° crank angle is definitely enhanced over many other positions, such as a 180° crank angle, it is believed that the preferred port position for maximum lubrication is that position where the port is fully open when the oil flow is at a maximum, rather than inertial force. Because of flow losses, this point must necessarily lag the maximum force position and can be determined two ways. The first and most accurate way is to use empirical techniques and actually measure flow rate at different crank angles and port locations. It is believed that this maximum flow position can also be approximated by assuming that the force value is a sinusoidal function of crank angle and that flow is a function of velocity (not force). Velocity in turn is the integral of acceleration, which is a function of force. Since the integral of a sine function is a cosine function, and since cosine and sine functions are out of phase by 90°, it can be assumed that the maximum flow position is approximately 90° out of phase (and lagging) the maximum force position. This approximation has been found to give excellent results, and is illustrated in FIG. 6A where it can be seen that port 118 is in full communication with groove 120 90° later than when the orbiting scroll member is at a maximum radial displacement position in the direction of port 118 (i.e., the port is at 90° which is 90° later than the 180° maximum force positions). This is the preferred location of the thrust bearing lubricating port 118 because it is close to the point of maximum flow due to inertial forces resulting from orbiting of the orbiting scroll member. In the embodiment of FIGS. 2–4 the oil injection port 119 is fed by the same passage 114 as port 118 and since passage 114 is always in communication with chamber 110 this may not be the most desirable injection arrangement, as will be discussed later herein. In studying FIGS. 5 and 6A it should be realized that 68 does not represent the hub per se on the orbiting scroll member (because these are merely diagrammatic views) but is intended merely to represent the inside thereof.

Figure 6B:
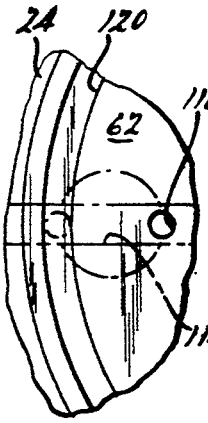
Figure 6A:
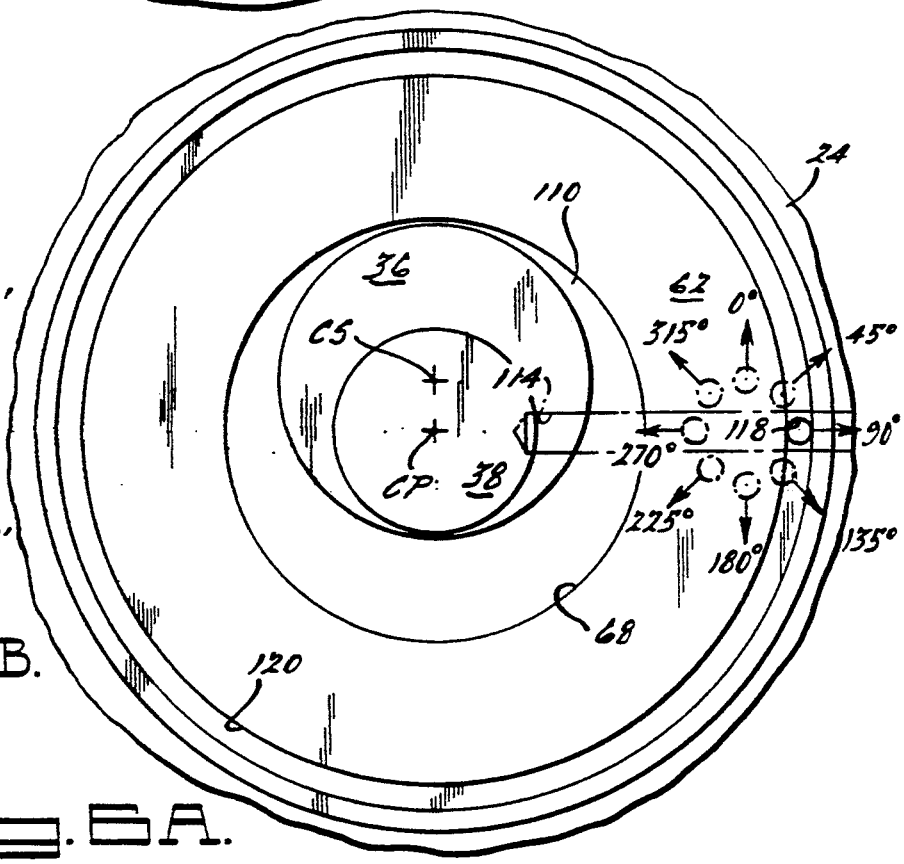

In FIG. 6B there is illustrated a variation in the arrangement of FIG. 6A, passage 114' having outlet port 118' is provided in end plate 65 for the purpose of also supplying lubricating oil to groove 120. Because passage 114' is disposed 180° away from passage 114 port 118' should be located so that it is in full communication with groove 120 (shown in phantom in FIG. 6B) after an additional 180° of crankshaft rotation from the position shown in FIG. 6A. As can be readily visualized, any number of passages 114' with ports 118' can be utilized at any angular positions desired, so long as the proper phase angles are maintained, thus insuring an even greater supply of lubricant to groove 120. In the same manner, multiple passages could also be used for oil injection.

In FIGS. 7–10 there is illustrated another embodiment of the invention in which the lubricating oil is supplied by a passage different from that which supplies oil for injection purposes. Furthermore, the oil injection passageway is positioned so as to time the supply of oil thereto to take advantage of inertial effects caused by orbiting of the orbiting scroll member. As in the previous use and throughout this specification, like numbers will be used to designate like elements. Oil for purposes of lubrication of the thrust bearing is provided by means of a passage 130, the inner end of which communicates with a chamber 126 and the outer end of which is plugged by means of a press fit plug 132, and an axial port 134 extending downwardly and communicating with the thrust bearing interface. As best seen in FIG. 1, chamber 126 is defined by bearing housing 24 and the inside diameter 128 of thrust bearing surface 62, and has hub 68 disposed therein. Under most operating conditions, chamber 126 contains a substantial amount of lubricating oil from bushing 72, bearing 70 and the thrust bearing. As noted above, port 134 can be located in any desired position in order to utilize the inertial forces of the orbiting scroll in the desired manner. Thus, it could be located in a maximum force position, a maximum flow position, or for that matter, any other desired position, using the criteria set forth above.

Oil for injection purposes is distributed via a passageway 136 disposed in end plate 65 and having a downwardly open inlet port 138 at its radially inner end and an upwardly directed outlet port 140 disposed radially outwardly therefrom. The radially outer end of passage 136 is plugged by means of a press fit plug 142. As before, port 140 is located adjacent the outer end of spiral wrap 66 so that the oil issuing therefrom will be drawn into the compressor with the suction gas. Inlet port 138, on the other hand, is positioned in such a place that it overlies cavity 126 during only a portion of the orbital movement of the orbiting scroll member. It must therefore be positioned in such a way that it is open to chamber 126, and thus supplied with lubricating oil, only during that portion of orbit in which the desired inertial forces are present; i.e., it can be positioned so that the flow therein is enhanced by inertial forces or it can be positioned so that flow therein is retarded by inertial forces, as will be discussed in greater detail in connection with FIGS. 15 and 16. In this embodiment it is positioned for maximum positive inertial flow.

In FIGS. 11–14 there is illustrated a different embodiment of the invention in which the lubricating oil is supplied by a passage different from that which supplies oil for injection purposes, and in which the oil injection passageway is positioned so as to time the supply of oil thereto to take advantage of inertial effects caused by orbiting of the orbiting scroll member. As in the previous embodiment, oil for purposes of lubrication of the thrust bearing is provided by means of a passage 130, the inner end of which always communicates with chamber 126 and the outer end of which is plugged by means of a press fit plug 132, and an axial port 134 extending downwardly and communicating with the thrust bearing interface. As noted above, port 134 can be located in any desired position in order to utilize the inertial forces of the orbiting scroll in the desired manner. Thus, as before, it could be located in a maximum force position, a maximum flow position, or for that matter, any other desired position, using the criteria set forth above.

Oil for injection purposes is distributed via a passageway 144 disposed in end plate 65 and having a downwardly open inlet port 146 at its radially inner end and an upwardly directed outlet port 148 disposed radially outwardly therefrom. The radially outer end of passage 144 is plugged by means of a press fit plug 150. As before, port 144 is located adjacent the outer end of spiral wrap 66 so that the oil issuing therefrom will be drawn into the compressor with the suction gas. Inlet port 146, on the other hand, is positioned in such a place that it overlies cavity 126 during only a portion of the orbital movement of the orbiting scroll member. It must therefore be positioned in such a way that it is open to chamber 126, and thus supplied with lubricating oil, only during that portion of orbit in which the desired inertial forces are present; i.e., it can be positioned so that the flow therein is enhanced by inertial forces or it can be positioned so that flow therein is retarded by inertial forces, as will be discussed in greater detail in connection with FIGS. 15 and 16. In this embodiment it is positioned for maximum negative inertial flow.

Figure 15:
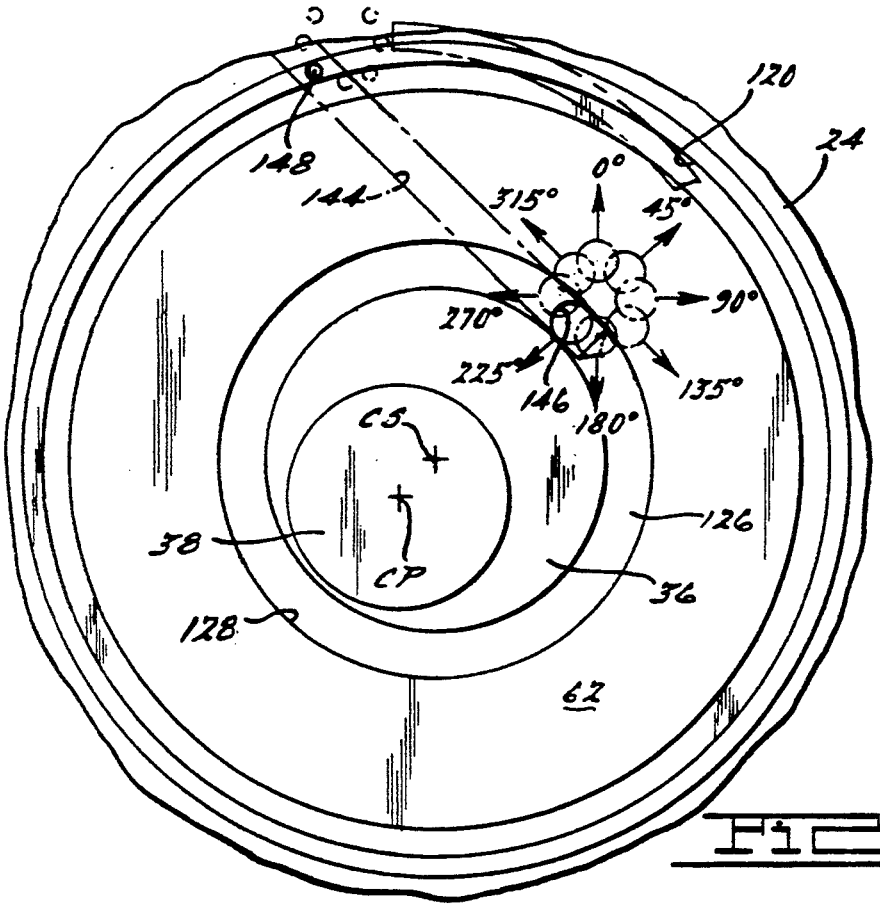
FIGS. 15 and 16 are further diagrammatic views illustrating certain port locations of the embodiments of FIGS. 7–14 as a function of crank angle.
Figure 16:
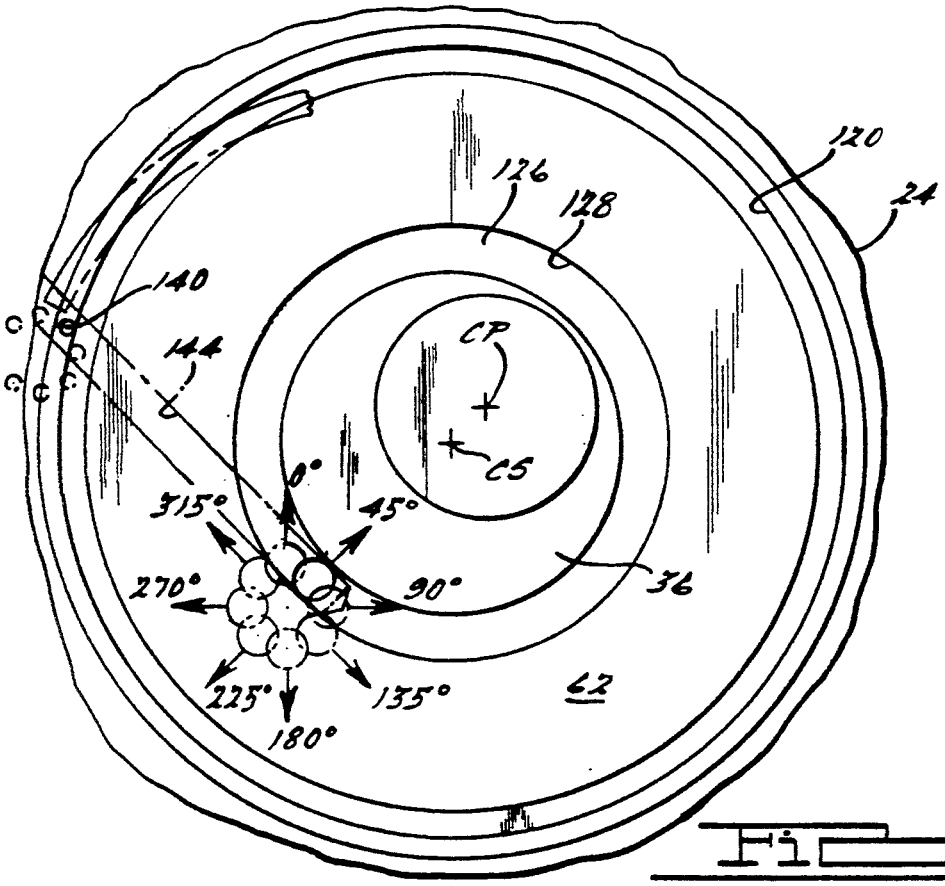
Figure 17:
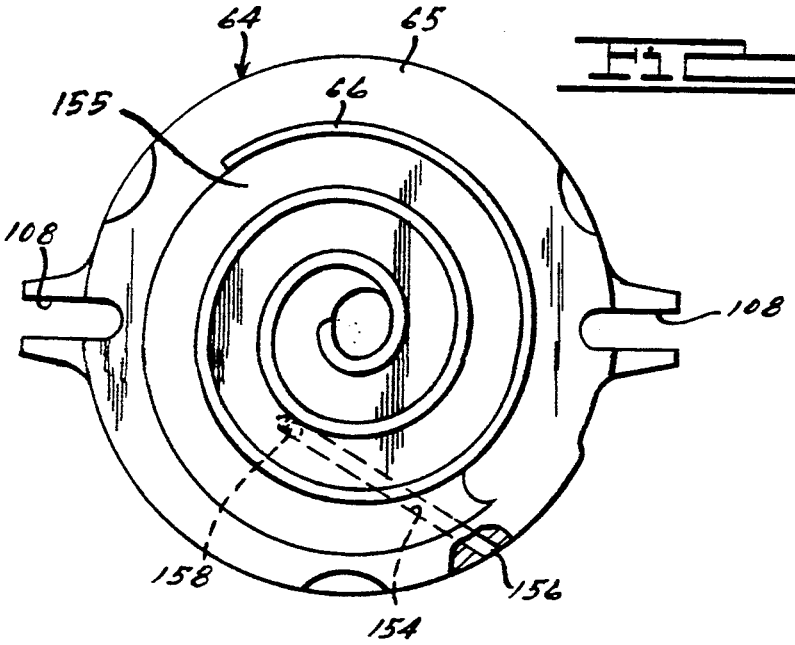
FIG. 17 is a top plan view of an orbiting scroll member incorporating a further embodiment of the present invention.
Figure 18:
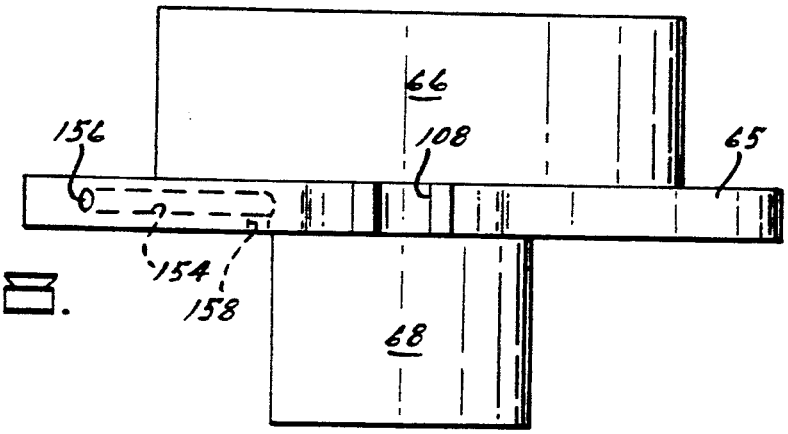
FIG. 18 is a side elevational view of the scroll member of FIG. 17.
Figure 19:
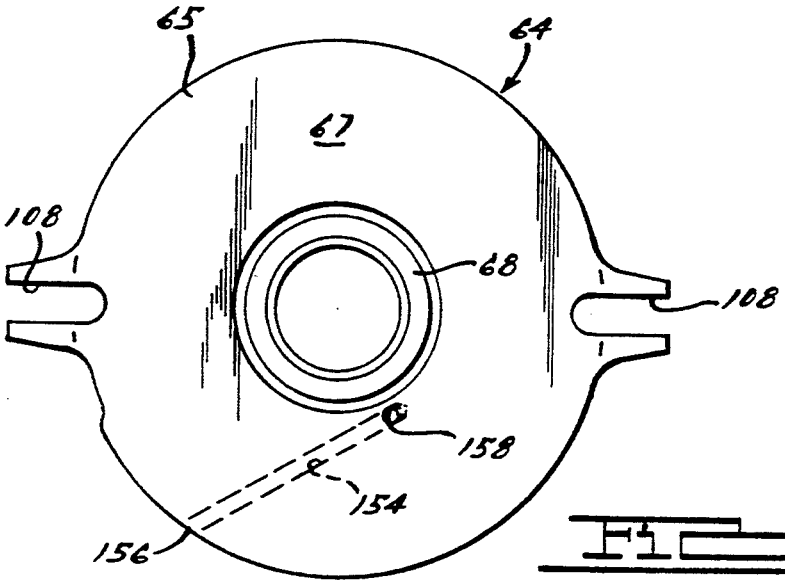
FIG. 19 is a bottom plan view of the scroll member of FIG. 17.

FIGS. 15 and 16 show diagrammatically the positioning of ports 146 and 148, respectively, to achieve the desired inertial effects. As can be seen in FIGS. 15 and 11, inlet port 146 is in full fluid communication with oil chamber 126 only when the crank angle is 225°, which is 90° later than the 135° position where the maximum negative force is exerted on the oil flowing to outlet port 148. In this arrangement, the flow of oil for injection purposes is subject to the maximum negative inertial influence caused by the orbiting of the oribiting scroll member. For oil injection this is the preferred arrangement for a variable speed compressor because at high compressor speeds the suction gas tends to draw in too much oil and the use of inertial forces is desirable to retard this flow. There is no excess retardation at low speeds because there are minimal centrifugal forces at low speeds.

Figure 7:
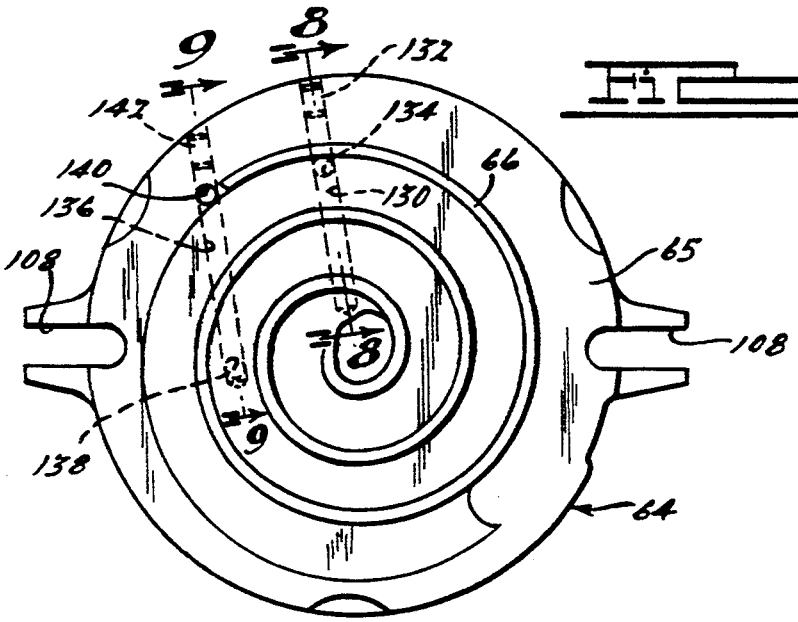
FIG. 7 is a top plan view of an alternative orbiting scroll member forming part of the present invention.
Figure 8:
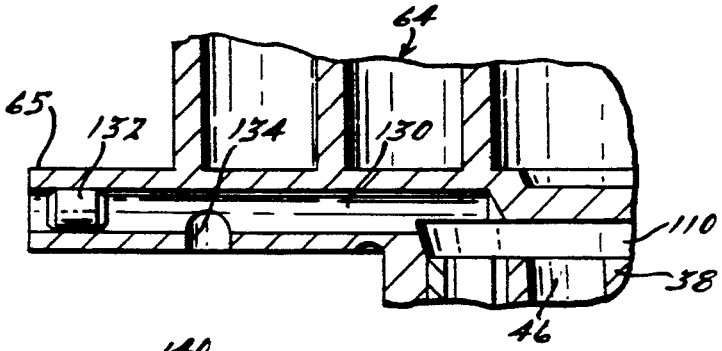
FIG. 8 is a vertical sectional view taken substantially along line 8—8 of FIG. 7.
Figure 9:
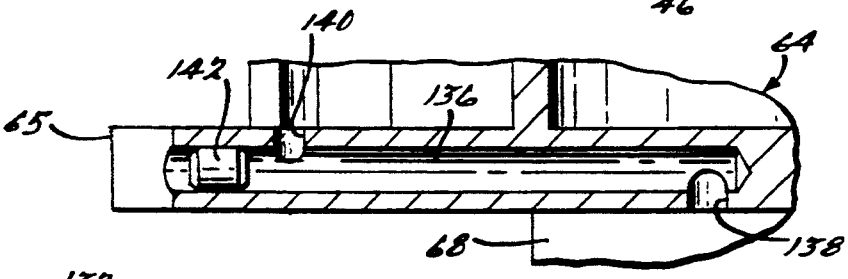
FIG. 9 is a vertical sectional view taken substantially along line 9—9 in FIG. 7.
Figure 10:
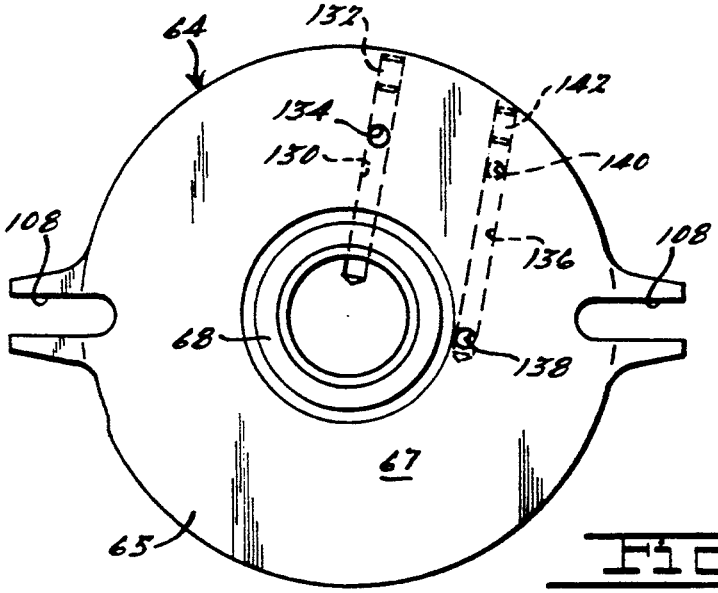
FIG. 10 is a bottom plan view of the orbiting scroll member of FIG. 7.

As can be seen in FIGS. 16 and 7, inlet port 138 is in full fluid communication with oil chamber 126 when the crank angle is 45°, which is 90° later than the 315° position where the maximum positive force is exerted on the oil flowing to outlet port 140. In this arrangement, the flow of oil for injection purposes is subject to the maximum positive inertial influence caused by the orbiting of the orbiting scroll member. It would be used when enhanced flow for injection is required.

In FIGS. 17–21 there is illustrated an embodiment of the invention in which chamber 126 is vented to release vapor in the lubricant which might block its flow and/or significantly reduce the lubricating qualities thereof; and in which the vent passage is positioned so as to time its communication with chamber 126 to take advantage of inertial effects caused by orbiting of the orbiting scroll member. In situations in which there is excess liquid in the compressor shell, the normal crankshaft vents may be flooded and the liquid in chamber 126 may be loaded with vapor. Venting in this situation is very desirable. Chamber 126 is vented by a passage 154 in end plate 65 having an outer vent opening 156 at the periphery of the end plate (and preferably as far away as possible from the suction inlet area 155), and a radially inner inlet port 158 positioned in such a place that it overlies cavity 126 during only a portion of the orbital movement of the orbiting scroll member. It must therefore be positioned in such a way that it is open to chamber 126, and thus supplied with lubricating oil, only during that portion of orbit in which the desired inertial forces are present; i.e., it can be positioned so that the flow therein is enhanced by inertial forces or it can be positioned so that flow therein is retarded by inertial-forces. In this embodiment it is positioned for maximum negative inertial flow.

Figure 20:
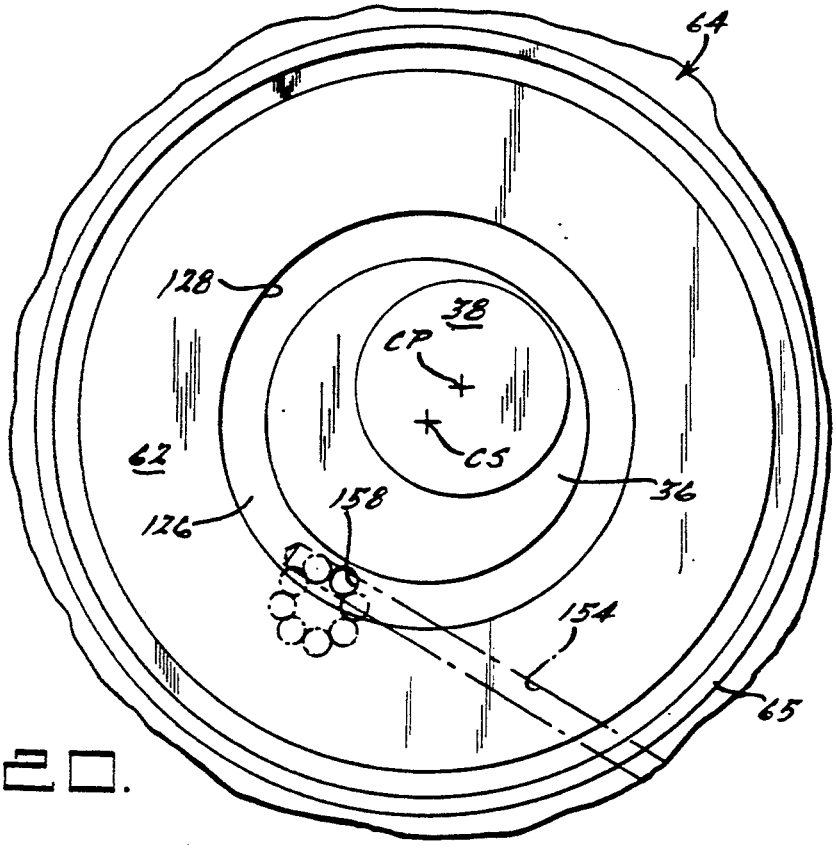
FIGS. 20 and 21 are further diagrammatic views illustrating certain port locations of the embodiment of FIGS. 17–19 as a function of crank angle.

As can be seen in FIG. 20, the maximum inertial force away from hole 156 is in the direction of a 315° crank angle. Port 158 is therefore located so that it is fully open to cavity 126 at a crank angle of 45°, or 90° later, where there is a maximum inertial deterrent to flow in a venting direction. This is the preferred arrangement because it is desirable to minimize the amount of liquid which flows through the vent. Having a higher mass, the liquid is more influenced by inertial forces than the vapor.

Figure 21:
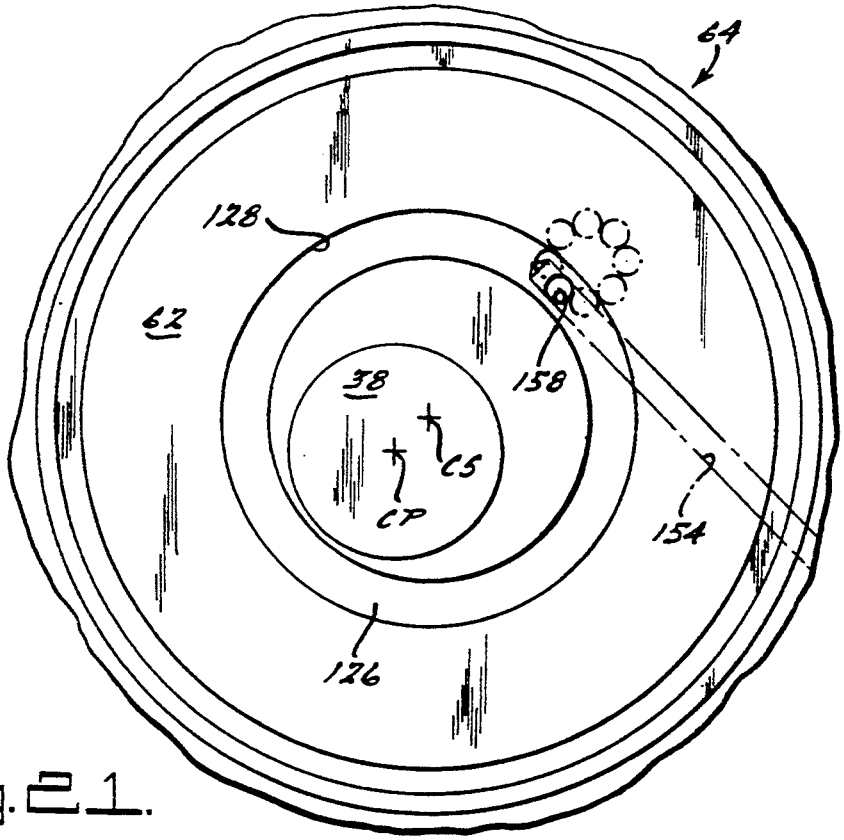

In the event it is desired to use inertial forces to enhance venting, then the arrangement of FIG. 21 can be used. Here, the inlet port is located at a position where it is in full communication with chamber 126 when the crank is at an angle of 225°, which is 90° past the maximum positive force crank angle of 135°.

It should be appreciated that in all of the embodiments the angles specified are approximate; however, this has been found to be sufficient. If exact angles are required, then they may be determined emperically by making actual flow and force measurements. It should also be noted that none of the oil feed or vent passages are positioned so that they cross over the center of the orbiting scroll member where they would be subject to centrifugal and/or inertial forces in opposite directions at the same time.

While this invention has been described in connection with these particular examples, no limitation is intended except as defined by the following claims. The skilled practitioner will realize that other modifications may be made without departing from the spirit of this invention after studying the specification and drawings.

We claim:

1. A scroll machine comprising:

a first scroll member that orbits about an axis to generate an inertial force substantially constant in magnitude and varying in direction, said first scroll member having a first spiral vane;

a second scroll member having a second spiral vane disposed in intermeshing relationship with said first spiral vane so that as said first scroll member orbits with respect to said second scroll member, moving pockets of changing volume are formed by said vanes;

passage means having a radial component in said first scroll member for placing a central zone adjacent said first scroll member in fluid communication with an outer zone disposed radially outwardly from said central zone;

inlet port means and outlet port means communicating with said passage means;

said inlet port and said outlet port being positioned so as to be open when the inertial forces created by orbital motion are in a direction to aid fluid flow in a predetermined direction, at least one of said inlet and outlet ports being positioned so as to be closed when said first scroll is in either a first or second position, said first position corresponding to a position of maximum orbital displacement of said first scroll in a direction of a radial component of said passage means and said second position corresponding to a position of minimum orbital displacement of said first scroll in a direction of a radial component of said passage means.

2. A scroll machine as claimed in claim 1 wherein said scroll machine includes oil supply means for supplying lubricating oil to a chamber disposed in the vicinity of said first scroll member, said inlet port communicating with said chamber.

3. A scroll machine as claimed in claim 2 wherein said outlet port supplies lubricating oil to inject into said moving pockets.

4. A scroll machine as claimed in claim 2 wherein said inlet and outlet ports are fully open when said first scroll member is in a position such that said inertial forces operate to maximize flow through said passage.

5. A scroll machine as claimed in claim 2 wherein said passage operates to vent vapor from said chamber.

6. A scroll machine as claimed in claim 1 wherein said outlet port is closed when said first scroll is in said first or second position.

7. A scroll machine comprising:

(a) a first scroll member having on one side a first spiral vane;

(b) a second scroll member having a second spiral vane disposed in interengaging relationship with said first spiral vane so that as said first scroll member orbits with respect to said second scroll member, moving pockets of changing volume are formed by said vanes;

(c) drive means for causing said scroll members to orbit with respect to one another with said first scroll member being subject to inertial forces about an axis;

(d) oil supply means for supplying lubricating oil to a chamber disposed in the vicinity of said first scroll member;

(e) a first passage in said first scroll member having a directional component extending in a direction having a radial component with regard to said axis, said first passage further having a first major longitudinal axis, the radially inner end of said first passage having a first inlet port adapted to be in communication with said chamber;

(f) a first outlet port in said first scroll member, said first outlet port being positioned radially outwardly from said first inlet port;

(g) first control means for controlling the flow through said first passage, said first control means being defined by the location of said first inlet and said first outlet ports, said first inlet and outlet ports being positioned to take advantage of said inertial forces created by the orbital motion of said first scroll member; and (h) a second passage in said first scroll member having a directional component extending in a direction having a radial component with regard to the axis of orbital movement thereof, said second passage having a second major longitudinal axis, said first and said second axes being laterally spaced apart and substantially parallel to one another, the radially inner end of said second passage having a second inlet port in fluid communication with said chamber and a second outlet port in said first scroll member connecting said second passage to a face of said first scroll member to permit fluid to flow from said chamber to said face, said second outlet port being positioned outwardly from said second inlet port, and second control means for controlling the flow through said second passage to take advantage of the inertial forces created by the orbital motion of said first scroll member.

8. A scroll machine as claimed in claim 7 wherein at least one of said outlet ports supply fluid in the form of lubricating oil to moving parts of said scroll machine.

9. A scroll machine as claimed in claim 7 wherein at least one of said outlet ports supply fluid in the form of oil to inject into said moving pockets.

10. A scroll machine as claimed in claim 7 wherein at least one of said outlet ports supply fluid in the form of vapor to vent said chamber.

11. A scroll machine as claimed in claim 7 wherein at least one of said control means causes flow through at least one of said passages to be enhanced by said inertial forces.

12. A scroll machine as claimed in claim 7 wherein at least one of said control means causes flow through at least one of said passages to be retarded by said inertial forces.

13. A scroll machine as claimed in claim 7 wherein said first outlet port supplies fluid in the form of lubricating oil to moving parts of said scroll machine, and said second outlet port supplies fluid in the form of oil to inject into said moving pockets.

14. A scroll machine as claimed in claim 13 wherein said first and second outlet ports communicate with opposite faces of said first scroll member.

15. A scroll machine as claimed in claim 7 wherein said control means functions to open and close said outlet port in response to the orbital position of said first scroll member.

16. A scroll machine as claimed in claim 7 wherein said control means functions to open and close said inlet port in response to the orbital position of said first scroll member.

17. A scroll machine as claimed in claim 7 wherein said one of said ports is fully open when the centrifugal forces resulting from said orbital movement are in a direction to maximize the inertial force on the fluid in said passage.

18. A scroll machine as claimed in claim 17 wherein said inlet port is in maximum communication with said chamber when said first scroll member is at approximately its maximum displacement orbital position in the direction of said outlet port.

19. A scroll machine as claimed in claim 7 wherein said one of said ports is fully open when the centrifugal forces resulting from said orbital movement are in a direction to maximize the flow of the fluid in said passage.

20. A scroll machine as claimed in claim 7 wherein at least one of said ports is fully open when the centrifugal forces resulting from said orbital movement are in a direction to minimize the inertial force on the fluid in said passages.

21. A scroll machine as claimed in claim 7 wherein at least one of said ports is fully open when the centrifugal forces resulting from said orbital movement are in a direction to minimize the flow of the fluid in at least one of said passages.

22. A scroll machine as claimed in claim 7 wherein said inlet port is in fluid communication with said chamber during a portion of the orbit of said first scroll member, and is out of communication with said chamber during another portion of said orbit.

23. A scroll machine as claimed in claim 7 wherein at least one of said outlet ports connect at least one of said passages to a face of said first scroll member, said passage is in fluid communication with said face during a portion of the orbit of said first scroll member, and is out of communication with said face during another portion of said orbit.

24. A scroll machine as claimed in claim 7 wherein said chamber is disposed in the central portion of said first scroll member.

25. A scroll machine comprising:

(a) a first scroll member having on one side a first spiral vane;

(b) a second scroll member having a second spiral vane disposed in interengaging relationship with said first spiral vane so that as said first scroll member orbits with respect to said second scroll member, moving pockets of changing volume are formed by said vanes;

(c) drive means for causing said scroll members to orbit with respect to one another with said first scroll member being subject to inertial forces about an axis;

(d) oil supply means for supplying lubricating oil to a chamber disposed in the vicinity of said first scroll member;

(e) a passage in said first scroll member having a directional component extending radially with regard to said axis, the radially inner end of said passage having an inlet port adapted to be in communication with said chamber;

(f) at least one outlet port in said first scroll member, said outlet port being positioned radially outwardly from said inlet port;

(g) control means for controlling the flow through said passage, said control means being defined by the location of at least one of said inlet and outlet ports, said inlet and outlet ports being positioned to take advantage of said inertial forces created by the orbital motion of said orbiting scroll member; and (h) a body defining a first generally annular thrust surface having an annular oil supply groove therein and a second annular thrust surface on said first scroll member in engagement with said first thrust surface and on the opposite side of said first spiral vane, said outlet port being positioned so that it is in fluid communication with said annular groove when it is at its maximum orbiting radius position, and is out of communication with said annular groove when it is at its minimum orbiting radius position.

26. A scroll machine comprising:

(a) a body defining a first generally annular thrust surface having an annular oil supply groove therein;

(b) a first scroll member having on one side a second generally annular thrust surface in engagement with said first thrust surface and on the opposite side a first spiral vane;

(c) a second scroll member having a second spiral vane disposed in interengaging relationship with said first spiral vane so that as said first scroll member orbits with regard to said second scroll member, moving pockets of changing volume are formed by said vanes;

(d) drive means for causing said first scroll member to orbit with regard to said second scroll member, with said first thrust surface taking the thrust loads in a direction said first and second scroll members tend to separate during operation;

(e) oil supply means for supplying lubricating oil to the central portion of said one side of said first scroll member;

(f) a passage in said first scroll member having a directional component extending radially with regard to the axis of orbital movement thereof, the radially inner end of said passage having an inlet port in fluid communication with the oil supply at said central portion of said first scroll member; and (g) an outlet port in said first scroll member connecting said passage to said second thrust surface, said outlet port being positioned so that it is in fluid communication with said annular supply groove only when the inertial forces on the oil in said passage means due to the orbiting of said first scroll member are in a direction to enhance oil flow from said outlet port to said groove.

27. A scroll machine as claimed in claim 26 wherein said inlet port is always in communication with said central portion of said first scroll member.

28. A scroll machine comprising:

(a) a first scroll member having on one side a first spiral vane;

(b) a second scroll member having a second spiral vane disposed in interengaging relationship with said first spiral vane so that as said first scroll member orbits with respect to said second scroll member, moving pockets of changing volume are formed by said vanes;

(c) drive means for causing said first scroll member to orbit with respect to said second scroll member;

(d) oil supply means for supplying lubricating oil to a chamber disposed in the central portion of said scroll machine;

(e) a vent passage in said first scroll member having a directional component extending in a direction having a radial component with regard to the axis of orbital movement thereof, the radially inner end of said passage having an inlet port for fluid communication with said chamber, the radially outer end of said passage having a plug member for preventing fluids from escaping the outer terminal end of said first scroll member;

(f) an outlet port in said first scroll member connecting said passage to a location adjacent the outer terminal end of said first spiral vane to vent vapor from said chamber, said outlet port being positioned radially outwardly from said inlet port; and (g) said inlet port being positioned so that it is in fluid communication with said chamber only when inertial forces of fluid in said passage due to the orbiting of said first scroll member are in a direction to enhance the flow of fluid in said passage.

29. A scroll machine as claimed in claim 28, further comprising a body defining a first generally annular thrust surface and a central opening therethrough, a second generally annular thrust surface on said first scroll member in engagement with said first thrust surface and on the opposite side of said first spiral vane, and a hub on said first scroll member disposed in said opening, and drivingly engaged by said drive means, said chamber including the space between said hub and said opening.

30. A scroll member as claimed in claim 29 wherein the edge of said opening acts as a valve to control fluid flow through said inlet port as said first scroll orbits.

31. A scroll machine comprising:

(a) a first scroll member having on one side a first spiral vane;

(b) a second scroll member having a second spiral vane disposed in interengaging relationship with said first spiral vane so that as said first scroll member orbits with respect to said second scroll member, moving pockets of changing volumes are formed by said vanes;

(c) drive means for causing said first scroll member to orbit with respect to said second scroll member;

(d) oil supply means for supplying lubricating oil to a chamber disposed in the central portion of said scroll machine;

(e) a vent passage in said first scroll member having a directional component extending in a direction having a radial component with regard to the axis of orbital movement thereof, the radially inner end of said passage having an inlet port for fluid communication with said chamber;

(f) an outlet port in said first scroll member connecting said passage to the face of said first scroll member adjacent the outer terminal end of said first spiral wrap to supply oil for injection into said pockets, said outlet port being positioned radially outwardly from said inlet port; and (g) said inlet port being positioned so that it is in fluid communication with said chamber only when inertial forces of fluid in said passage due to the orbiting of said first scroll member are in a direction to retard the flow of oil through said passage.

32. A scroll machine comprising:

(a) a first scroll member having on one side a first spiral vane;

(b) a second scroll member having a second spiral vane disposed in interengaging relationship with said first spiral vane so that as said first scroll member orbits with respect to said second scroll member, moving pockets of changing volume are formed by said vanes;

(c) drive means for causing said first scroll member to orbit with respect to said second scroll member;

(d) oil supply means for supplying lubricating oil to a chamber disposed in the vicinity of said first scroll member;

(e) a passage in said first scroll member having a directional component extending radially with regard to the axis of orbiting movement thereof, the radially inner end of said passage having an inlet port adapted to be in fluid communication with said chamber;

(f) an outlet port in said first scroll member connecting said passage to a face of said first scroll member to permit fluid to flow from said chamber to said face, said outlet port being positioned radially outwardly from said inlet port; and (g) control means residing in positioning one of said ports for controlling the flow through said passage to take advantage of the inertial forces created by the orbital motion of said first scroll member, said inlet port being positioned relative to said chamber and said outlet port being positioned relative to said face, said inlet port being in maximum communication with said chamber when said first scroll member is approximately 90° behind its maximum radial displacement orbital position in the direction of said inlet port and being inhibited from communicating with said chamber when said scroll member is approximately 270° behind its maximum radial displacement orbital position in the direction of said inlet port.

33. A scroll machine comprising:

(a) a first scroll member having on one side a first spiral vane;

(b) a second scroll member having a second spiral vane disposed in interengaging relationship with said first spiral vane so that as said first scroll member orbits with respect to said second scroll member, moving pockets of changing volume are formed by said vanes;

(c) drive means for causing said first scroll member to orbit with respect to said second scroll member;

(d) oil supply means for supplying lubricating oil to a chamber disposed in the vicinity of said first scroll member;

(e) a passage in said first scroll member having a directional component extending radially with regard to the axis of orbital movement thereof, the radially inner end of said passage having an inlet port adapted to be in fluid communication with said chamber;

(f) an outlet port in said first scroll member connecting said passage to a face of said first scroll member to permit fluid to flow from said chamber to said face, said outlet port being positioned radially outwardly from said inlet port; and (g) control means residing in positioning one of said ports for controlling the flow through said passage to take advantage of the inertial forces created by the orbital motion of said first scroll member, said one of said ports being fully open when the centrifugal forces resulting from said orbital movement are in a direction to minimize the inertial force on the fluid in said passage and said inlet port being in maximum communication with only said chamber when said first scroll member is at approximately its maximum orbital position in the opposite direction of said outlet port.

34. A scroll machine comprising:

(a) a first scroll member having on one side a first spiral vane;

(b) a second scroll member having a second spiral vane disposed in interengaging relationship with said first spiral vane so that as said first scroll member orbits with respect to said second scroll member, moving pockets of changing volume are formed by said vanes;

(c) drive means for causing said first scroll member to orbit with respect to said second scroll member;

(d) oil supply means for supplying lubricating oil to a chamber disposed in the vicinity of said first scroll member;

(e) a passage in said first scroll member having a directional component extending radially with regard to the axis of orbital movement thereof, the radially inner end of said passage having an inlet port adapted to be in fluid communication with said chamber;

(f) an outlet port in said first scroll member connecting said passage to a face of said first scroll member to permit fluid to flow from said chamber to said face, said outlet port being positioned radially outwardly from said inlet port; and (g) control means residing in positioning one of said ports for controlling the flow through said passage to take advantage of the inertial forces created by the orbital motion of said first scroll member, said one of said ports being fully open when the centrifugal forces resulting from said orbital movement are in a direction to minimize the flow of the fluid in said passage and said inlet port being in maximum communication with said chamber when said first member is approximately 90° behind its maximum radial displacement orbital position in the opposite direction of said outlet port and being inhibited from communicating with said chamber when said first member is approximately 270° behind its maximum radial displacement orbital position in the direction opposite of said outlet port.

35. A scroll machine comprising:

(a) a first scroll member having on one side a first spiral vane;

(b) a second scroll member having a second spiral vane disposed in interengaging relationship with said first spiral vane so that as said first scroll member orbits with respect to said second scroll member, moving pockets of changing volume are formed by said vanes;

(c) drive means for causing said first scroll member to orbit with respect to said second scroll member;

(d) oil supply means for supplying lubricating oil to a chamber disposed in the vicinity of said first scroll member;

(e) a passage in said first scroll member having a directional component extending radially with regard to the axis of orbital movement thereof, the radially inner end of said passage having an inlet port adapted to be in fluid communication with said chamber;

(f) an outlet port in said first scroll member connecting said passage to a face of said first scroll member to permit fluid to flow from said chamber to said face, said outlet port being positioned radially outwardly from said inlet port;

(g) control means for controlling the flow through said passage to take advantage of the inertial forces created by the orbital motion of said first scroll member; and (h) a body defining a first generally annular thrust surface having an annular oil supply groove therein and a second annular thrust surface on said first scroll member in engagement with said first thrust surface and on the opposite side a first spiral vane, said outlet port being positioned so that it is in fluid communication with said annular supply groove only when the inertial forces on the oil in said passage due to the orbiting of said first scroll member is in a direction to enhance oil flow from said port to said groove, said outlet port being positioned so that it communicates with said annular groove when it lags by 90° its maximum orbiting radius position, and is out of communication with said annular groove when it is at its minimum orbiting radius position.

36. A scroll machine comprising:

(a) a body defining a first generally annular thrust surface having an annular oil supply groove therein;

(b) a first scroll member having on one side a second generally annular thrust surface in engagement with said first thrust surface and on the opposite side a first spiral vane;

(c) a second scroll member having a second spiral vane disposed in interengaging relationship with said first spiral vane so that as said first scroll member orbits with regard to said second scroll member, moving pockets of changing volume are formed by said vanes;

(d) drive means for causing said first scroll member to orbit with regard to said second scroll member, with said first thrust surface taking the thrust loads in a direction said first and second scroll members tend to separate during operation;

(e) oil supply means for supplying lubricating oil to the central portion of said one side of said first scroll member;

(f) a passage in said first scroll member having a directional component extending radially with regard to the axis of orbital movement thereof, the radially inner end of said passage having an inlet port in fluid communication with the oil supply at said central portion of said first scroll member; and (g) an outlet port in said first scroll member connecting said passage to said second thrust surface, said outlet port being positioned so that it is in fluid communication with said annular supply groove only when the inertial forces on the oil in said passage means due to the orbiting of said first scroll member are in a direction to enhance oil flow from said outlet port to said groove, said outlet port being positioned so that it communicates with said annular groove when it is at a position lagging by approximately 90° its maximum orbiting radius position, and is out of communication with said annular groove when it is at a position lagging by approximately 90° its minimum orbiting radius position.

37. A scroll machine comprising:

(a) a first scroll member having on one side a first spiral vane;

(b) a second scroll member having a second spiral vane disposed in interengaging relationship with said first spiral vane so that as said first scroll member orbits with respect to said second scroll member, moving pockets of changing volume are formed by said vanes;

(c) drive means for causing said first scroll member to orbit with respect to said second scroll member;

(d) oil supply means for supplying lubricating oil to a chamber disposed in the central portion of said scroll machine;

(e) a vent passage in said first scroll member having a directional component extending in a direction having a radial component with regard to the axis of orbital movement thereof, the radially inner end of said passage having an inlet port in fluid communication with said chamber;

(f) an outlet port in said first scroll member connecting said passage to a face of said first scroll member to vent vapor from said chamber, said outlet port being positioned radially outwardly from said inlet port; and (g) said inlet port being positioned so that it is in fluid communication with said chamber only when inertial forces on fluid in said passage due to the orbiting of said first scroll member are in a direction to enhance vapor flow, said inlet port being positioned so that it communicates with said chamber when it is at a position lagging by approximately 90° its maximum orbiting radius position, and is out of communication with said chamber when it is at a position lagging by approximately 90° its minimum orbiting radius position.

38. A scroll machine comprising:

(a) a first scroll member having on one side a first spiral vane;

(b) a second scroll member having a second spiral vane disposed in interengaging relationship with said first spiral vane so that as said first scroll member orbits with respect to said second scroll member, moving pockets of changing volume are formed by said vanes;

(c) drive means for causing said first scroll member to orbit with respect to said second scroll member;

(d) oil supply means for supplying lubricating oil to a chamber disposed in the central portion of said scroll machine;

(e) a vent passage in said first scroll member having a directional component extending in a direction having a radial component with regard to the axis of orbital movement thereof, the radially inner end of said passage having an inlet port in fluid communication with said chamber;

(f) an outlet port in said first scroll member connecting said passage to a face of said first scroll member to vent vapor from said chamber, said outlet port being positioned radially outwardly from said inlet port; and (g) said inlet port being positioned so that it is in fluid communication with said chamber only when inertial forces on fluid in said passage due to the orbiting of said first scroll member are in a direction to retard vapor flow, said inlet port being positioned so that it communicates with said chamber when it is at a position lagging by approximately 90° its minimum orbiting radius position, and is out of communication with said chamber when it is at a position lagging by approximately 90° its maximum orbiting radius position.

39. A scroll machine comprising:

(a) a first scroll member having on one side a first spiral vane;

(b) a second scroll member having a second spiral vane disposed in interengaging relationship with said first spiral vane so that as said first scroll member orbits with regard to said second scroll member, moving pockets of changing volume are formed by said vanes;

(c) drive means for causing said first scroll member to orbit with respect to said second scroll member;

(d) oil supply means for supplying lubricating oil to a chamber disposed in the central portion of said scroll machine;

(e) a vent passage in said first scroll member having a directional component extending in a direction having a radial component with regard to the axis of orbital movement thereof, the radially inner end of said passage having an inlet port in fluid communication with said chamber;

(f) an outlet port in said first scroll member connecting said passage to the face of said first scroll member adjacent the outer terminal end of said first spiral wrap to supply oil for injection into said pockets, said outlet port being positioned radially outwardly from said inlet port; and (g) said inlet port being positioned so that it is in fluid communication with said chamber only when inertial forces on fluid in said passage due to the orbiting of said first scroll member are in a direction to increase fluid flow, said inlet port being positioned so that it communicates with said chamber when it is at a position lagging by approximately 90° its maximum orbiting radius position, and is out of communication with said chamber when it is at a position lagging by approximately 90° its minimum orbiting radius position.

* * * * *

UNITED STATES PATENT AND TRADEMARK OFFICE

CERTIFICATE OF CORRECTION

PATENT NO. : 5,395,224

DATED : March 7, 1995

INVENTOR(S) : Jean-Luc Caillat; Stephen M. Seibel

It is certified that error appears in the above-indentified patent and that said Letters Patent is hereby corrected as shown below:

Column 4, line 20, "part" should be — port —.

Column 8, line 1, "emperically" should be — empirically —.

Signed and Sealed this

Eighteenth Day of July, 1995

*Attest:*

*Attesting Officer*

BRUCE LEHMAN

*Commissioner of Patents and Trademarks*